US006859180B1

(12) United States Patent
Rivera

(10) Patent No.: US 6,859,180 B1
(45) Date of Patent: Feb. 22, 2005

(54) GRAVITY-ACTUATED SUBMARINE ANTENNA

(75) Inventor: David F. Rivera, Westerly, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 4 days.

(21) Appl. No.: 10/663,059

(22) Filed: Sep. 15, 2003

(51) Int. Cl.[7] ..... H01Q 1/34; H01Q 1/04
(52) U.S. Cl. ..... 343/709; 343/719
(58) Field of Search ..... 343/709, 719, 343/876, 905, 908, 913, 898, 895; 340/984, 985; 333/236, 242; H01Q 1/34, 1/04

(56) References Cited

U.S. PATENT DOCUMENTS 3,665,478 A 5/1972 Dempsey ..... 343/725
4,675,691 A 6/1987 Moore ..... 343/908
4,766,441 A 8/1988 Phillips ..... 343/709
5,870,064 A * 2/1999 Kaegebein ..... 343/853
6,058,874 A * 5/2000 Glenning et al. ..... 114/328
6,127,983 A 10/2000 Rivera ..... 343/767
6,683,579 B1 * 1/2004 Riveria ..... 343/709

* cited by examiner

*Primary Examiner*—Trinh Vo Dinh
(74) *Attorney, Agent, or Firm*—James M. Kasischke; Michael P. Stanley; Jean-Paul A. Nasser

(57) ABSTRACT

An antenna including a feed tube with radial fins and circular plates at the ends of the tube and fins thereby forming a boundary for a plurality of resonant cavities. Curved plates, connected to the tube by switches of a switching system, partially encompass and subtend to the length of the tube. Interior to the tube, a transmission line from an end plate terminus conducts radio-frequency energy from the terminus to a hub and onto a switch of the switching system in which the switch is mechanically reactive to and actuated by a righting action of the curved plates when the curved plates encounter a sea state. When actuated, energy from the switch distributes to a proximate resonant cavity and curved plate to form a radiation pattern based on the difference in phase of the resonant cavity and curved plate.

12 Claims, 8 Drawing Sheets

GRAVITY-ACTUATED SUBMARINE ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to antennas and more particularly to radiators for low profile, towed antennas.

(2) Description of the Prior Art

Present submarine communications with battlegroups or shore sites utilize surface antennas for a variety of requirements including SATCOM, LOS, etc. The use of surface antennas typically interferes with the covert operation of the submarine. For example, data exchange or the receipt of commands is accomplished by using antennas within a mast, which must be extended whenever transmission or reception is required. For communications in coastal or littoral areas, raising a mast renders the submarine vulnerable to visual or radar detection. To mitigate such detection, buoyant cable antennas (BCA) are often used. However, current BCAs cannot be used effectively for transmission, due to their extremely low radiation efficiency.

Furthermore, antennas towed on the ocean surface are subjected to dynamic forces that act to cause the antenna to pitch, yaw and sometimes roll under varying sea states. These antenna movements can easily result in transmission and reception interruption, especially so with the use of directional antennas. As a result, the towing submarine must operate in a station keeping status or must constantly adjust course headings in order to obtain optimal antenna performance.

In Rivera et al. (U.S. Pat. No. 6,127,983), there is disclosed a wideband antenna capable of transmission and reception while the antenna is towed horizontally in the ocean behind the submarine or vessel. Specifically, the antenna of the cited reference is formed as a metal cylinder having a longitudinal slot with the longitudinal slot open at one end and closed at the other end. The cylindrical shape in a towing container provides a strong righting moment to the antenna with the result of efficient broadband coverage under varying sea states.

Also, by setting the terminations of the antenna, that is, the open end, the closed end, and the feedpoint (along with the antenna diameter and thickness, and slot length and width) an antenna having a good impedance match over a wide frequency band is produced.

As disclosed, the above antenna is clearly suitable for wideband transmission when being towed in the ocean; however, an alternative antenna is desirable to produce an increased effectiveness during operation and an increased range of use when compared to the above antenna as well as for other known buoyant antennas.

SUMMARY OF THE INVENTION

Accordingly, it is a general purpose and primary object of the present invention to provide an antenna that can transmit a directionalized radiation pattern with minimal interruption when operating in varying sea states.

It is a further object of the present invention to provide an antenna in which the antenna construction is simple and economical.

It is a still further object of the present invention to provide an antenna with an increased antenna gain.

It is a still further object of the present invention to provide an antenna that operates efficiently over a wide band of frequencies.

It is a still further object of the present invention to provide an antenna in which the operation of the antenna is roll stable.

It is a still further object of the present invention to provide an antenna that emits a symmetrical radiation pattern in the fore/aft and athwart directions.

To attain the objects described there is provided a gravity-actuated antenna suitable for towing horizontally on the ocean surface in which the antenna includes a switching system that actuates the antenna when facing "up" toward the sky or ocean surface. The antenna comprises a cylindrical feed tube with three radially extending fins and disk plates secured to ends of the feed tube and the fins. A plurality of the curved plates spaced apart an extending plane of the fins and projecting from an end plate partially encompass and subtend to the length of the feed tube with each curved plate connected to the feed tube by the protecting structure of a gravity-actuated electrical switch.

The fins of the antenna are spaced evenly around the circumference of the feed tube. Each fin is sized to form a longitudinal radiation boundary of a resonant cavity and the end plates are sized to form an athwart radiation boundary of the resonant cavity with the exterior of the feed tube forming the base of the resonant cavity. The boundaried resonant cavity is shallow enough that the cavity is not shadowed by the radial fins and the end plates. Without a shadow condition restricting a wavelength generated in the resonant cavity during antenna actuation, a resultant symmetrical radiation pattern can be transmitted in conjunction with the actuation of a specified curved plate.

The feed tube encompasses a first transmission line from a feedpoint terminus at one end plate to a cylindrical feed hub within the feed tube. The transmission line is capable of conducting radio-frequency energy from the terminus to the hub and onto an individual electrical switch when the switch is gravity-actuated as a result of a righting motion of the curved plates. Energy from the hub via the switch and onto a specified curved plate and further onto the resonant cavity results in a current distribution across the curved plate and the resonant cavity such that a difference in phase between both results in the radiation pattern beamed from the antenna. Based on the sizing of the components of the antenna, the resultant radiation pattern can be transmitted from a fore and aft direction in relation to the antenna as well as at an athwart direction and at a direction perpendicular to the axis of the feed tube.

By decreasing the diameter of the transmission line from the feedpoint terminus to the hub, the transmission line performs an impedance transformation over its length. The impedance transformation of the transmission line among varying diameters presents a variable load ($\Omega$) at the feedpoint terminus thereby allowing the antenna to emit over a range of frequencies.

A second transmission line with a diameter equal to the smallest diameter of the first transmission line and electrically connectable to the hub, continues from the hub onto a second terminus at the other end plate. The second transmission line and the second terminus behave as a reactive impedance to match the impedance at the connection of a pin of the switch and the hub. By matching the impedance, an optimum amount of radio-frequency energy can be transferred onto the actuated switch and curved plate with a result in increased gain of the antenna.

The above and other features of the invention, including various and novel details of construction and combinations of parts will now be more particularly described with reference to the accompanying drawings and pointed out in the claims. It will be understood that the particular devices embodying the invention are shown by way of illustration only and not as the limitations of the invention. The principles and features of this invention may be employed in various and numerous embodiments without departing from the scope of the invention.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
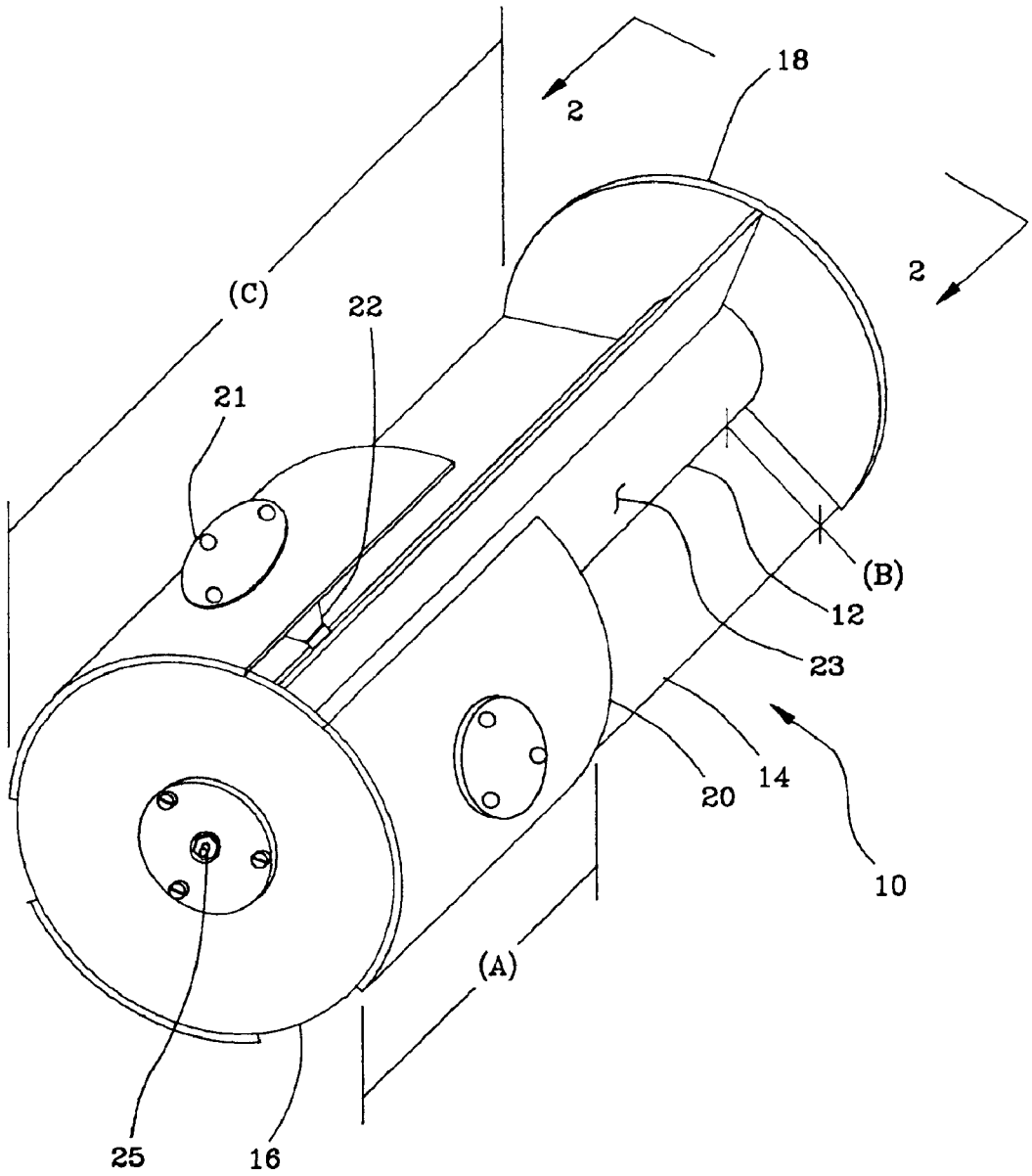
FIG. 1 is a perspective view of the gravity-actuated antenna of the present invention showing the physical configuration of the antenna.

Referring now to the drawings wherein like numerals refer to like elements throughout the several views, one sees that FIG. 1 depicts the gravity-actuated submarine antenna 10 of the present invention. The antenna 10 is preferably cast with a rigid thickness from aluminum with brass electrically conductive components attached. Other commonly acquired materials or methods known to those skilled in the art may be used in forming the antenna 10. Such a variant in antenna formation would be molding the antenna 10 from plastic and plating the antenna with a conductive material. Another non-exclusive variant in antenna formation would be molding the antenna 10 from conductive material.

The simplified structure of the antenna 10 generally comprises a cylindrical feed tube 12 with radially extending fins 14 and disk plates 16, 18 secured to ends of the feed tube 12 and the fins 14. A plurality of curved metal plates 20 spaced apart from the fins 14 and projecting from the end plate 16 partially encompass the length of the feed tube 12 with each curved plate 20 connected to the feed tube 12 by a flange 21 and the protective structure of an electrical switch 22.

Each curved plate 20 of the antenna 10 projects at a distance (A) of $\lambda/3$ from the end plate 16, wherein $\lambda$ is the wavelength corresponding to the center design frequency. The center design frequency is the geometric mean frequency between the frequencies provided to the antenna 10. Each curved plate 20 subtends to the feed tube 12 at an angle in the range of 45° to 90°, with the high end of the range preferred for broadened antenna bandwidth.

The radial fins 14 of the antenna 10 are spaced at 120° from each other around the circumference of the feed tube 12. Each radial fin 14 is sized to form a longitudinal radiation boundary of a resonant cavity 23 (a volume shown) with the dimensions of each radial fin 14 at $\lambda/22$ in width (B) and $2\times\lambda/5$ in length (C). The end plates 16, 18 are sized to form an athwart radiation boundary of the resonant cavity 23 with the diameter of each of the end plates 16, 18 sized to be $\lambda/8$. An exterior of the feed tube 12 forms the base of the resonant cavity 23.

The boundaried resonant cavity 23 is shallow enough that the cavity is not shadowed by the radial fins 14 nor the end plates 16, 18. Without a shadow condition restricting a wavelength generated in the resonant cavity 23 during actuation of the antenna 10, a resultant symmetrical radiation pattern 24 can be transmitted in conjunction with the actuation of a specified curved plate 20. As discussed below for FIG. 6, the resultant radiation pattern 24 can be transmitted from a fore and aft direction as well as at an athwart direction and at a direction perpendicular to the axis of the feed tube 12.

Figure 2:
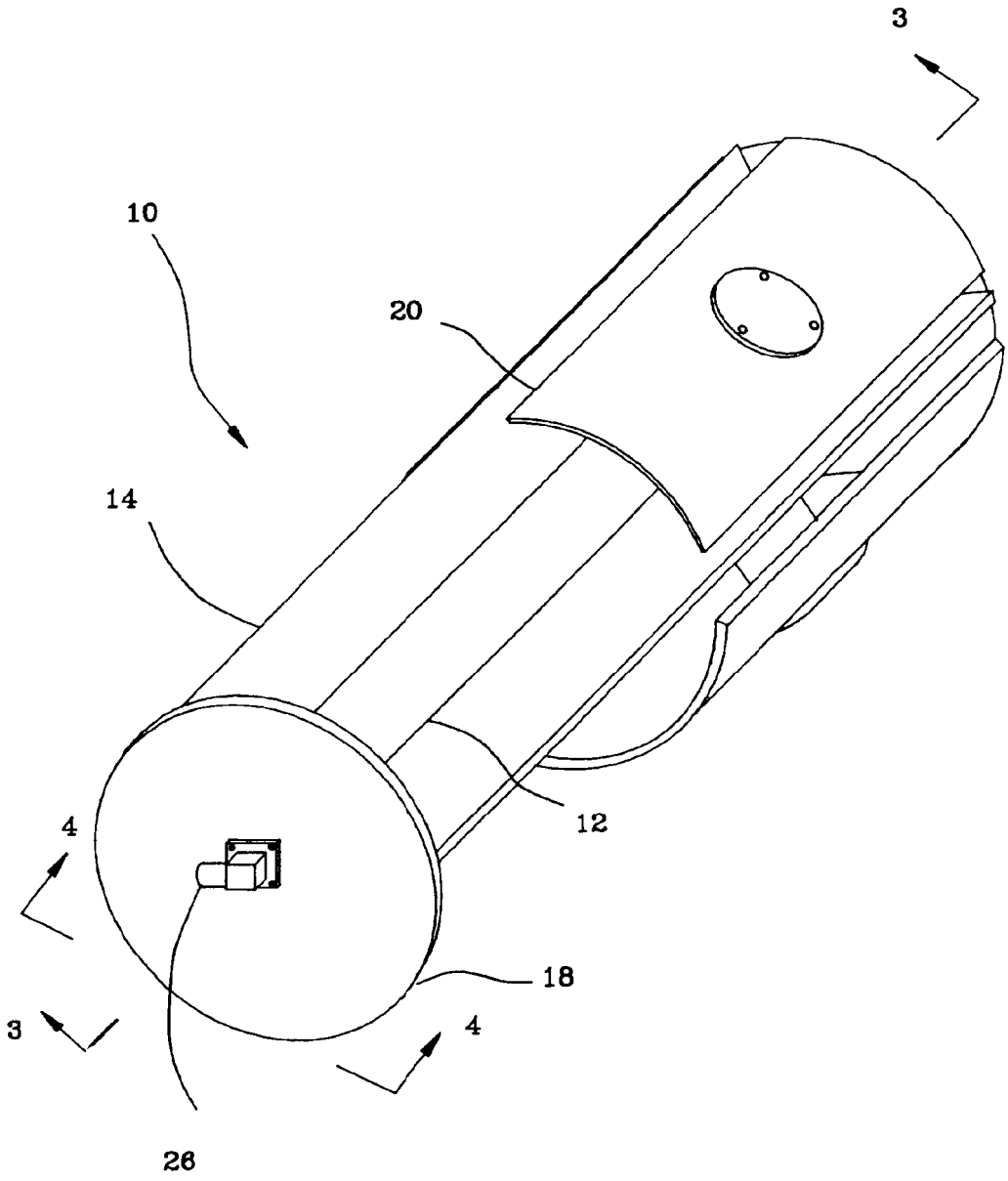
FIG. 2 is an alternate perspective view of the antenna of the present invention with the view taken from reference line 22 of FIG. 1.

The end plate 16 further includes a stub terminus 25 to the feed tube 12 through a central portion of the end plate 16 and as shown in FIG. 2, the end plate 18 includes a feedpoint terminus 26 to the feed tube 12 through a central portion of the end plate 18. The terminus 26 and the terminus 25 are respectfully at the ends of the coaxial transmission lines 30 and 32 shown in FIG. 3.

Figure 3:
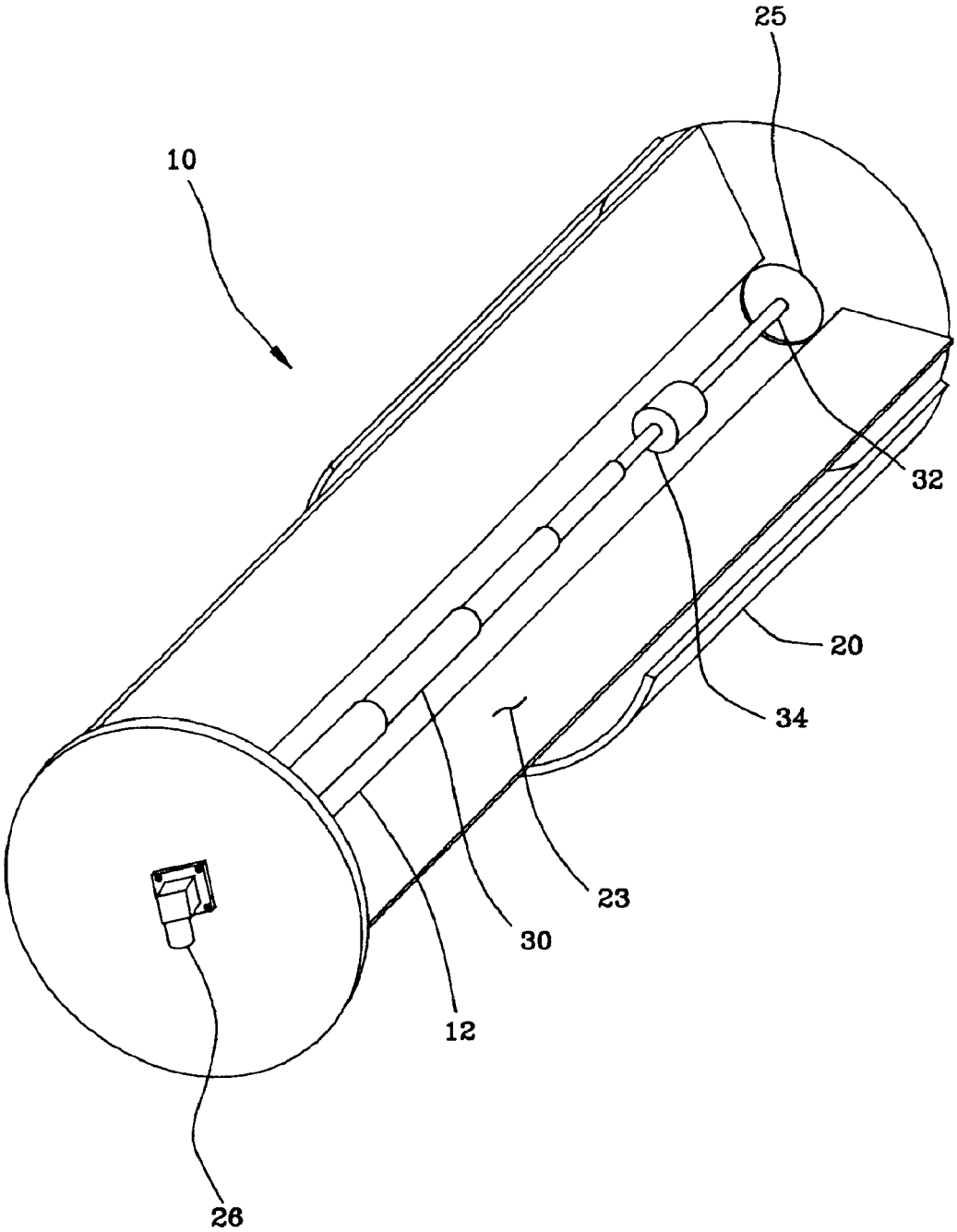
FIG. 3 is a cross-sectional view of the antenna of the present invention with a curved plate of the antenna removed for a clarified view of the electrical transmission structure of the antenna with the view taken from reference line 3—3 of FIG. 2.

As shown in the cross-sectional view of FIG. 3, the feed tube 12 encompasses and protects the transmission line 30 with the transmission line 30 continuing from the terminus 26 to a cylindrical feed hub 34. The diameter of the feed tube 12 is sized to contain the transmission lines 30 and 32 without impacting the impedance seen at the hub 34 such that the diameter of the feed tube is slightly larger than the hub 34.

Figure 5:
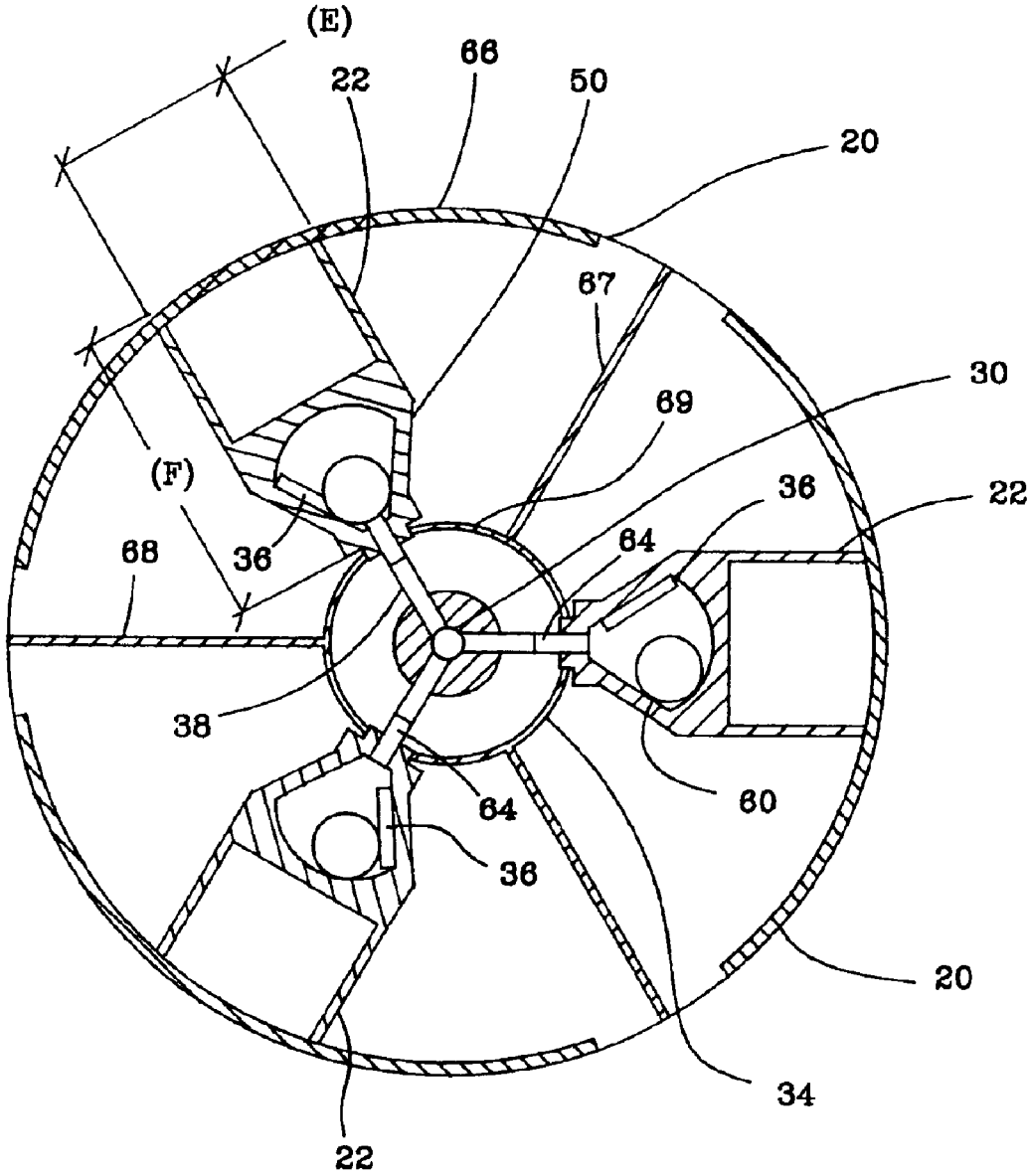
FIG. 5 is a cross-sectional view of the conductive relationship of the feed hub to the electrical switches of the antenna of the present invention with the view taken from reference line 5—5 of FIG. 4.
Figure 7:
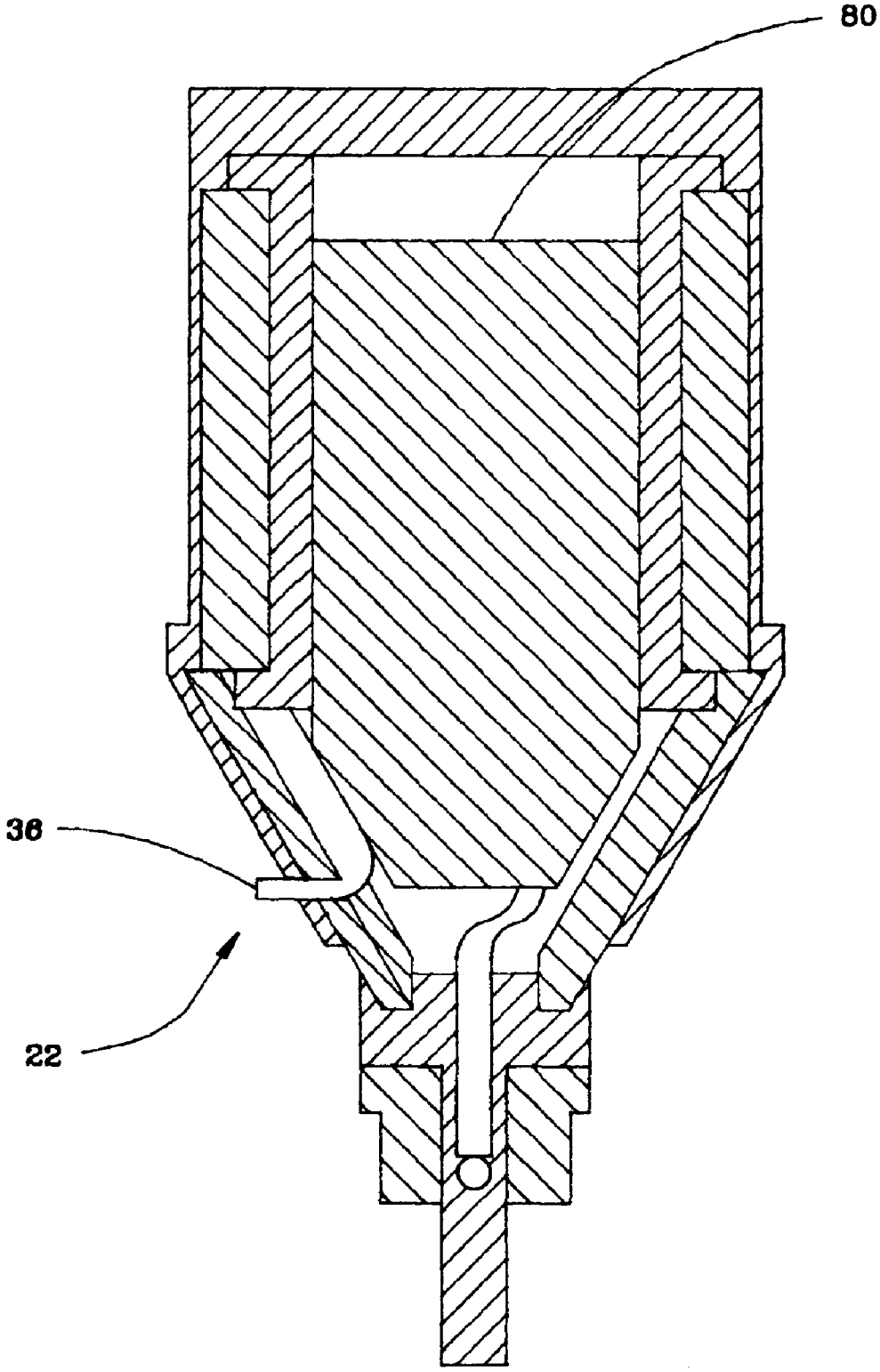
FIG. 7 is a cross-sectional view of a first variant of the electrical switch of the antenna of the present invention.
Figure 8:
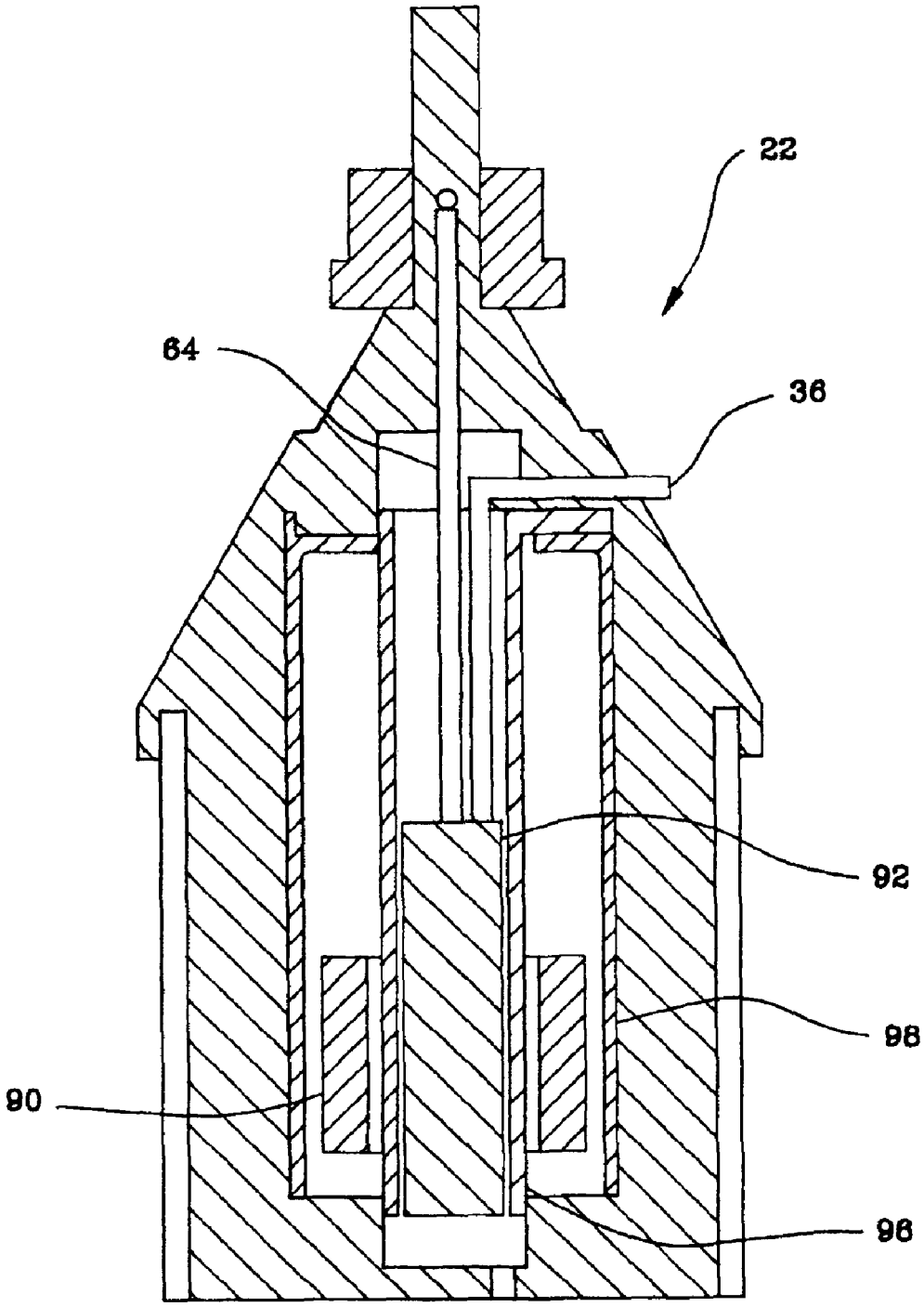
FIG. 8 is a cross-sectional view of a second variant of the electrical switch of the antenna of the present invention.

The transmission line 30 is capable of conducting radio-frequency energy from the terminus 26 to the hub 34 and onto an individual electrical switch 22 when the switch 22 is actuated by the electrical connection of the hub 34 to the switch 22 (the connection of conducting wire 36 within the switch 22 is shown in FIG. 5, FIG. 7 and FIG. 8). Energy from the switch 22 and onto a specified curved plate 20 and outward to the resonant cavity 23 results in the radiation pattern 24 of the antenna 10.

By decreasing the diameter of the transmission line 30 in a stepwise or tapered manner, the transmission line 30 performs an impedance transformation over its length. The impedance transformation of the transmission line 30 among varying diameters presents a variable load (Ω) at the terminus 26 thereby allowing the antenna 10 to emit over a range of frequencies. Because the switch 22 and the curved plate 20 would each have a unique impedance based on their structure and size, the degree of tapering of the transmission line 30 (or lack thereof) also depends on the dimensions of the switch 22 and the curved plate 20.

As further shown in FIG. 3, the second transmission line 32 has a diameter equal to the smallest diameter of the transmission line 30. The second transmission line 32 is electrically connectable to the hub 34 and continues from the hub 34 onto the terminus 25 such that the transmission line 32 the terminus 25 behave as a short-circuit electrically in parallel with the connection of a pin 38 of the switch 22 and the hub 34. The length and the diameter of the transmission line 32 determines the amount of reactive impedance of the transmission 32 to match the impedance at the connection of the pin 38 and the hub 34. By matching the impedance, an optimum and undistorted amount of radio-frequency energy can be transferred onto the actuated switch 22 and curved plate 20 with a result in increased gain of the antenna 10.

Figure 4:
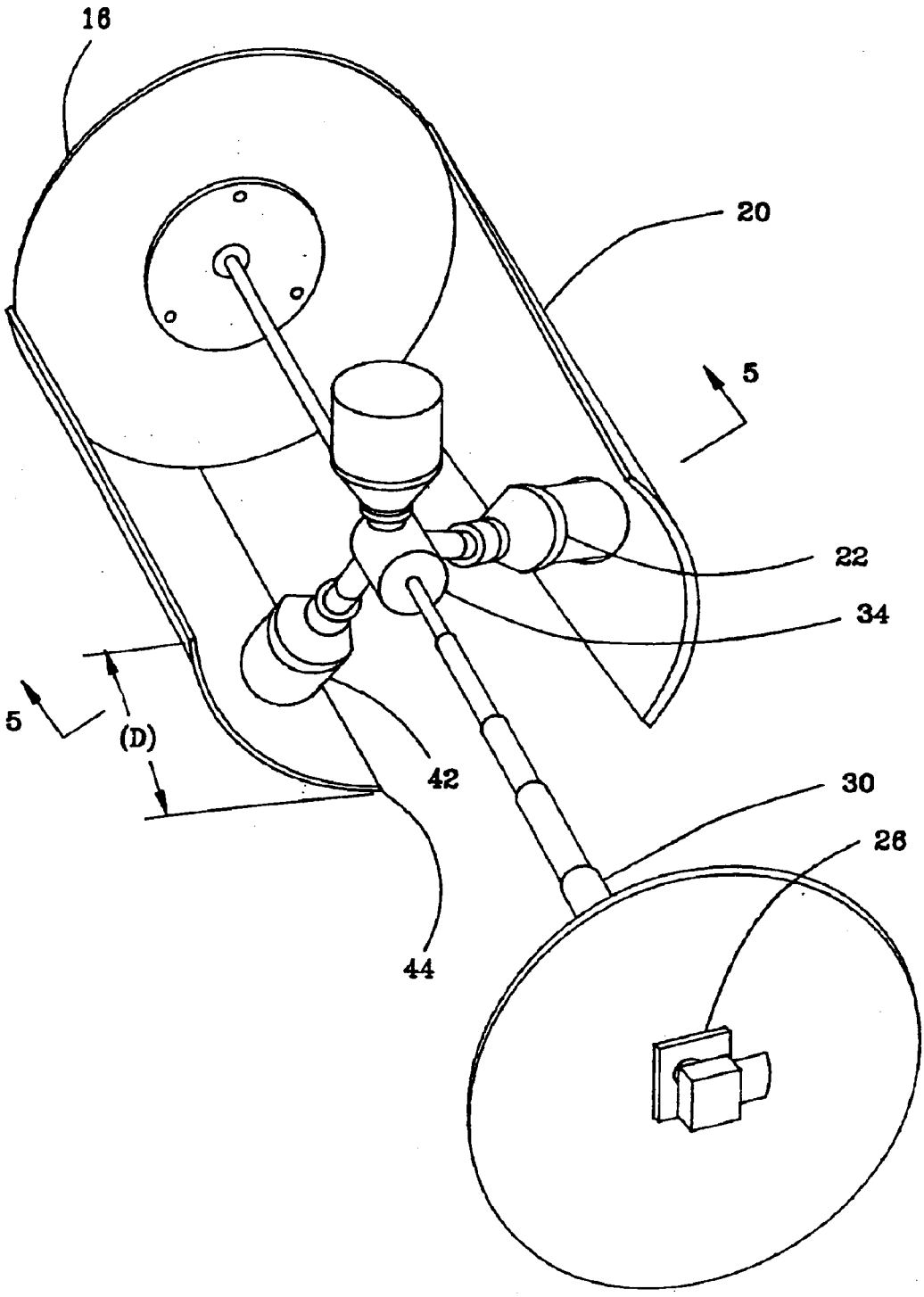
FIG. 4 is an end view of the antenna of the present invention with a curved plate, the feed tube and the radial fins of the antenna removed and with the view inverted for a clarified view of the electrical switch configuration of the antenna with the view taken from reference line 4—4 of FIG. 2.

As shown in FIG. 4, the antenna 10 preferably includes three switches 22 positioned equidistant along the circumference of the feed tube 12 with the attached curved plates 20 also positioned equidistant. Since three curved plates 20 are attached, the chord width (D) of the curved plate 20 can be maximized to enhance a angular range of a righting or "facing up" action that mechanically actuates the switch 22. By maintaining the righting action of the actuated switch 22 over a widened range, the operation of the antenna 10 thereby becomes roll-stable during towing. Additionally, the maximum chord width (D) of the curved plate 20 permits a greater bandwidth to be emitted from the antenna 10. Because the attachment point of the switch 22 to the curved plate 20 also affects the impedance bandwidth of the antenna 10, the preferred attachment point 42 is $\lambda/6$ from the open edge 44.

A cross-sectional view of the electrical switch 22 of the antenna 10 used for the actuation described below is shown in FIG. 5; however, other suitable variations of the switch 22 are described for FIG. 7 and FIG. 8. As stated above, the dimensions of the switch 22, specifically its supporting structure, can affect the impedance seen at the terminus 26. As such, the desired diameter (E) of the switch 22 is $\lambda/45$ and the desired height (F) of the switch 22 is $\lambda/22$. The conical taper 50 of the switch 22 preferably has an angle of 45° and occupies 25% of the switch height (F). While the dimensions of the supporting structure of the switch 22 are preferred for a center design frequency over which the antenna 10 maintains a good impedance match, other supporting structures for the switch 22 such as a cylinder without a taper may be used with compensating changes in the diameter (E) and the height (F).

In the operation of the antenna 10, the feedpoint terminus 26 of the transmission line 30 is connected to a energized feed source (not shown) at a portion of the UHF spectrum from 240–270 MHz. The transmission line 30 allows the radio-frequency energy to be conducted via the hub 34 and onto an electrical switch 22. The conductive function of the switch 22 is actuated by gravity whenever the attached curved plate 20 is righted or faces "upwards" as a result of wave action buoying the curved plate 20. The attached curved plate 20 is typically able to be righted at an angle greater than 17° relative to a horizontal plane.

When the curved plate 20 is righted and the switch 22 inclines, a metal sphere 60 rolls to contact the conducting wire 36, conductive to the structure of the switch 22, with a wire 64 in contact with the pin 38. Energy from the hub 34 via the pin 38 continues to the curved plate 20. The energy to the curved plate 20 results in a sinusoidal current distribution flowing along and across a surface 66 of the curved plate 20. The direction and intensity of the current distribution varies with the frequency of the antenna 10.

When energized, the switch 22 also emits a sinusoidal wave that sets up a current distribution on a surface 67, 68 of the fins 14 and a surface 69 of the feed tube 12 in the resonant cavity 23. The differences in phase from the various radiating surfaces 66, 67, 68 and 69 contributes to the generally hemispherical radiation or beam pattern 24, shown in FIG. 6.

Figure 6:
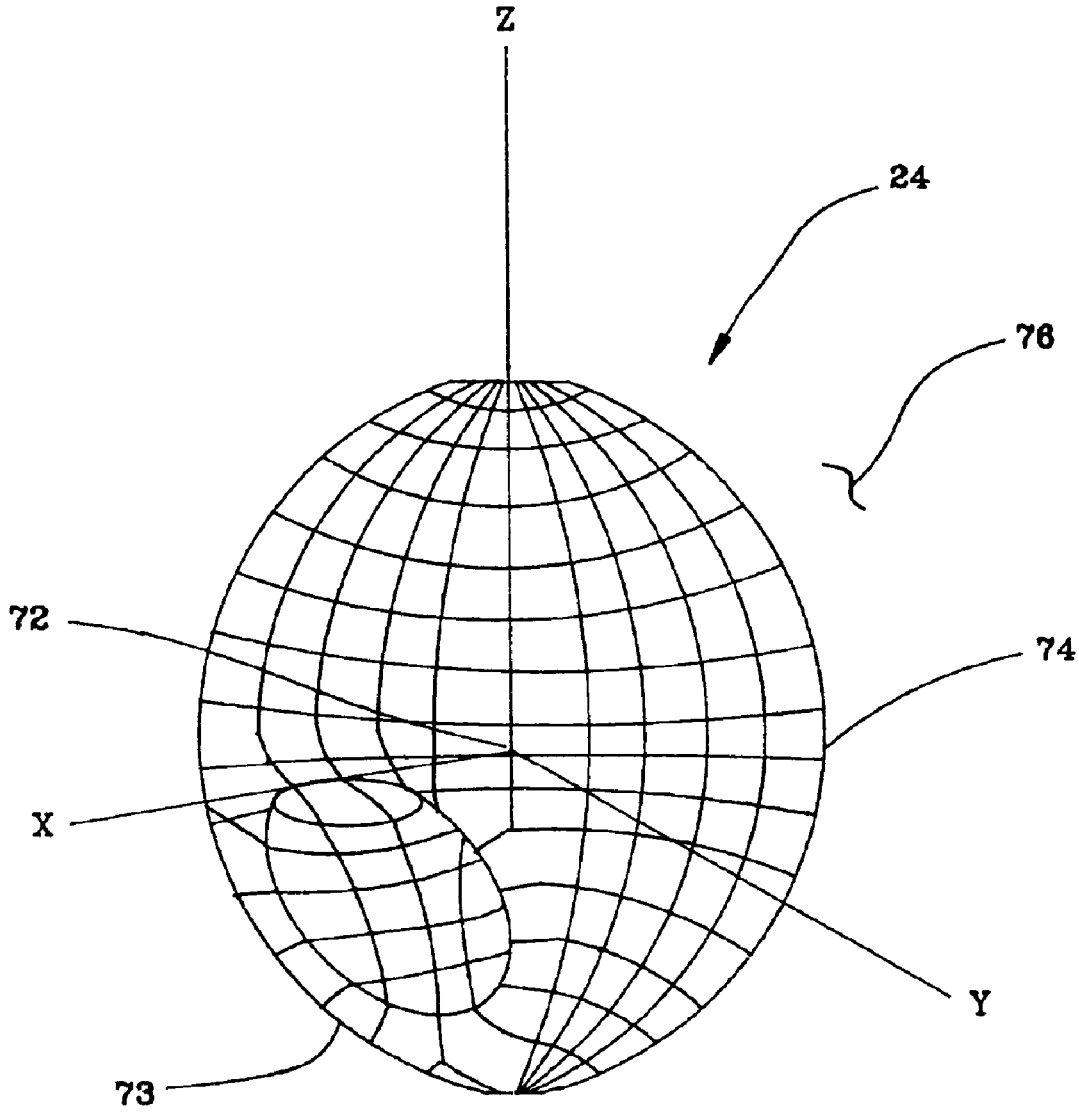
FIG. 6 is a three-dimensional view of a radiation pattern formed by the antenna of the present invention.

In FIG. 6, the radiation pattern 24 is depicted as a mathematical surface known as a horn cyclide (a variant of a toroid) with a null 72 from the center the horn cyclide to the lower point 73 of a surface 74. The horn-cyclide shaped radiation pattern 24 is advantageous because when the antenna 10 is placed on the ocean surface, the radiation pattern 24 in the air space above the ocean surface (shown by the area 76 above the plane defined by the "x" and "y" coordinates) has a minimal null area. As such, the radiation pattern 24 in the air space permits full directionalized transmission allowing the towing submarine to communicate when is the antenna 10 is subject to conditions of pitch, yaw, and varying degrees of roll since the antenna 10 will be righted to the plane defined by the "x" and "y" coordinates and coincident to the ocean surface.

Since the emitting area of the radiation pattern 24 is symmetrical, problems associated with asymmetrical radiation patterns are avoided. The symmetrical radiation pattern 24 of the antenna 10 allows the submarine or ship to operate the antenna for optimal antenna performance without station keeping or adjusting course headings.

An additional feature of the present invention is that the structural ratio (identified by the wavelength dimensioning above) of the various components of the antenna 10 allows the radiation pattern 24 to remain symmetrical while maintaining the compactness of the antenna 10. The compactness of the antenna 10 is naturally advantageous for many reasons including detection minimalization and reduced drag. In defining the compactness feature, the outer physical boundary of the antenna 10 is based on the size and placement of the end plates 16, 18 and the curved plates 20. For example, each curved plate 20 of the antenna 10 projects at a distance (A) of $\lambda/3$ from the end plate 16 with the diameter of the end plates 16, 18 sized to be $\lambda/8$, therefore any remaining structure of the antenna 10 would be within a circumferential boundary created by the above dimensions. Also, the radial fins 14 of the antenna 10 are 2 times $\lambda/5$ in length (C) therefore any remaining structure of the antenna 10 would be within a longitudinal boundary created by the dimension of the radial fins 14.

While the metal sphere 60 shown in FIG. 5 is used in the actuation of the switch 22 described above, other variations of electrical contact within the switch 22 may be used. In a first variant of the switch 22 shown in FIG. 7, the sphere 60 of the switch 22 is substituted with a metal plunger 80. The use of the plunger 80 may be preferred in some circumstances since the shape as well as the size of the plunger 80 can affect the angle of gravity-actuation.

In a second variation of the switch 22 shown in FIG. 8, the plunger 80 or sphere 60 is substituted with a gravity-actuated magnet 90. When the curved plate 20 is righted and the switch 22 inclines, the magnet 90 slides to close the normally open contacts of the reed switch 96. This allows the reed switch 96 to be conductive to the structure of the switch 22 by the conducting wires 38 and 64. The magnetic material for the switch 22 must have a substantial mass to perform a switch but the material also must have a stable magnetic field. In order not to affect the magnetic field or impedance properties of the antenna 10, the switch 22 may be lined with magnetic shielding foil material 98.

Thus by the present invention its objects and advantages are realized and although preferred embodiments have been disclosed and described in detail herein, its scope should be determined by that of the appended claims.

What is claimed is:

1. An antenna for a towed, low-profile submarine buoy comprising:

a tube;

fins along a length of said tube;

a first circular plate with an aperture, said first circular plate secured to a first end of said tube and said fins;

a second circular plate secured to a second end of said tube and said fins wherein said first and second circular plates, an exterior of said tube and said fins define a plurality of resonant cavities;

a first transmission line extending through an interior of said tube with said first transmission line including a feedpoint terminus removably conductive to a radio-frequency energy source, said feedpoint terminus filling out said aperture of said first circular plate;

a hub with a cylindrical exterior and two ends with one end of said hub conductive to an opposite terminus of said first transmission line;

a plurality of curved plates spaced apart from an extending plane of said fins and projecting from said second circular plate, each of said curved plates subtending to partially encompass a facing resonant cavity from said plurality of resonant cavities; and a plurality of electrical switches individually attaching said curved plates to said tube with each individual switch including a contact movable in a cavity of said individual switch;

wherein a righting action of said curved plates inclines said cavity thereby allowing said contact to move to an-actuated position such that radio-frequency energy from the radio-frequency energy source conducted from said hub to said individual switch; and wherein the radio-frequency energy conducted by said individual switch distributes from said individual switch as current across said individually attached curved plate and said facing resonant cavity such that a radiation pattern is formed by the difference in phase of said facing resonant cavity and said individually attached curved plate.

2. The antenna in accordance with claim 1, wherein each of said plurality of switches further comprises a pin conductive to said contact and said hub and said hub further comprises radial recesses sized to accommodate said pin from each of said plurality of electrical switches.

3. The antenna in accordance with claim 2, wherein said second circular plate further comprises an aperture and said antenna further comprises a second transmission line extending through the interior of said tube from said hub to a terminus of said second transmission line filling out said aperture of said second circular plate, the diameter of said second transmission line being equivalent to the diameter of said first transmission line whereby said second transmission line matches the impedance of said first transmission line conducted at said hub.

4. The antenna in accordance with claim 2, wherein the diameter of said first transmission line decreases from said feedpoint terminus to said hub thereby allowing an impedance transformation of the radio-frequency energy conducted over the length of said first transmission line.

5. The antenna in accordance with claim 4, wherein said second circular plate further comprises an aperture and said antenna further comprises a second transmission line extending through the interior of said tube from said hub to a terminus of said second transmission line filling out said aperture of said second circular plate, the diameter of said second transmission line being equivalent to the smallest diameter of said first transmission line whereby said second transmission line matches the impedance of said first transmission line conducted at said hub.

6. The antenna in accordance with claim 5, wherein said each of said plurality of curved plates are spaced apart from each other at a third of the circumference of said feed tube.

7. The antenna in accordance with claim 6, wherein said each of said plurality of curved plates subtends to said facing resonant cavity at an angle in the range of 45° to 90°.

8. The antenna in accordance with claim 7, wherein said fins extend from said tube at a dimension of a wavelength of the radio-frequency energy divided by a factor of twenty-two and said first and second circular plates are dimensioned at a diameter of the wavelength divided by a factor of eight whereby the dimensioning of said fins and said first and second circular plates reduces a shadow condition of said fins and said first and second circular plates around said antenna such that the radiation pattern beyond said facing resonant cavity is emitted symmetrically.

9. The antenna in accordance with claim 8, wherein said plurality of curved plates projects from said second circular plate at a dimension of the wavelength divided by a factor of three whereby the dimensioning of said curved plates from said second circular plate defines a circumferential boundary of said antenna and said fins are dimensioned at a length of the wavelength divided by a factor of five and multiplied at a factor of two whereby the dimensioning of said fins defines a longitudinal boundary of said antenna.

10. The antenna in accordance with claim 9, wherein said contact is a sphere.

11. The antenna in accordance with claim 9, wherein said contact is a cylinder.

12. The antenna in accordance with claim 9, wherein the righting action of said curved plates inclines said cavity thereby allowing a magnet to the actuated position thereby influencing said contact to the actuated position such that the radio-frequency energy from the radio-frequency energy source conducted from said hub to said individual switch.

* * * * *